US008061547B2

(12) United States Patent
Camp, Jr.

(10) Patent No.: US 8,061,547 B2
(45) Date of Patent: Nov. 22, 2011

(54) INSULATED STORAGE CONTAINER HAVING A REMOVABLE LINER

(76) Inventor: William P. Camp, Jr., Findlay, OH (US)

( * ) Notice: Subject to any disclaimer, the term of this patent is extended or adjusted under 35 U.S.C. 154(b) by 446 days.

(21) Appl. No.: 10/720,865

(22) Filed: Nov. 24, 2003

(65) Prior Publication Data

US 2005/0109776 A1 May 26, 2005

(51) Int. Cl.
*B65D 1/24* (2006.01)

(52) U.S. Cl. ..... 220/507; 220/592.23; 220/592.25; 220/526

(58) Field of Classification Search ..... 220/507, 220/526, 592.23, 23.87, 592.25
See application file for complete search history.

(56) References Cited

U.S. PATENT DOCUMENTS

| | | | | | |
|---|---|---|---|---|---|
| 2,496,296 | A | * | 2/1950 | Lobl | 62/329 |
| 3,016,129 | A | * | 1/1962 | King, III | 206/545 |
| 3,799,386 | A | * | 3/1974 | Madalin et al. | 206/564 |
| 3,971,360 | A | * | 7/1976 | Spoeth, Jr. | 220/495.05 |
| 4,040,517 | A | * | 8/1977 | Torokvei | 206/144 |
| 4,106,597 | A | * | 8/1978 | Shook et al. | 190/110 |
| 4,293,079 | A | * | 10/1981 | Lytle | 220/833 |
| 4,759,467 | A | | 7/1988 | Byrne | 220/404 |
| 4,899,904 | A | * | 2/1990 | Dooley et al. | 220/592.16 |
| 5,027,972 | A | * | 7/1991 | Bartholomew | 220/526 |
| 5,050,335 | A | | 9/1991 | Hisey | 43/55 |
| 5,193,032 | A | * | 3/1993 | Hirth | 359/804 |
| 5,305,544 | A | * | 4/1994 | Testa, Jr. | 43/54.1 |
| 5,350,078 | A | * | 9/1994 | Potts et al. | 215/384 |
| 5,445,276 | A | | 8/1995 | Gordon | 206/545 |
| 5,505,307 | A | | 4/1996 | Shink | 206/541 |
| 5,758,513 | A | | 6/1998 | Smith | 62/457.5 |
| 5,860,281 | A | | 1/1999 | Coffee et al. | 62/3.62 |
| 6,065,303 | A | | 5/2000 | Harris | 62/457.5 |
| 6,151,910 | A | | 11/2000 | Hazen | 62/457.2 |
| 6,305,299 | B1 | * | 10/2001 | Ragland | 108/44 |
| 6,325,210 | B1 | * | 12/2001 | Henry, Jr. | 206/427 |
| 6,527,116 | B1 | * | 3/2003 | Gale | 206/427 |

* cited by examiner

*Primary Examiner* — Stephen Castellano
(74) *Attorney, Agent, or Firm* — Timothy A. Nathan

(57) ABSTRACT

The present invention comprises an insulated container having a liner fitted therein. The liner is removable, reusable, and washable. The insulated container also has an insulated partition defining a pair of thermally isolated compartments to maintain different temperatures in each compartment. To secure the liner in place, a latch is provided, and to vent trapped air, the liner includes a channel. The liner is also configured to shed water when inverted in a washing machine so that the liner can be easily sterilized. An additional unique feature of this invention is that the liner also includes coupling cavities configured to accept various bottles and cans to prevent the bottle or can from tipping over inside the insulated container.

17 Claims, 10 Drawing Sheets

INSULATED STORAGE CONTAINER HAVING A REMOVABLE LINER

BACKGROUND OF THE INVENTION

1. Field

The present invention generally relates to storage containers. More specifically, the present invention relates to insulated storage containers.

2. Background

Insulated storage containers are well known in the art and are commonly used to isolate their contents from the external environment. To cool the contents of the container, ice or a sealed gel refrigerant may be used to suppress the internal temperature of the container below ambient temperature. Alternatively, a sealed gel heat pack may be used to elevate the internal temperature of the container above ambient. Sportsmen, campers, picnickers, and mothers of newborns have found insulated containers to be particularly useful when electrically powered refrigerators and food warmers are unavailable.

Several attempts have been made to enhance the functionality of insulated containers. For instance, U.S. Pat. No. 5,305,544 describes a bait storage cooler and tackle holder used to store bait and food. This insulated container has a lower portion that is divided into two compartments by a non-insulated wall and includes a lid having recesses to receive and support beverage cans. The non-insulated wall permits the two compartments to be maintained at a similar temperature while preventing intermingling of the contents. For instance, bait in one compartment can be separated from food contained in the other compartment.

Separating the contents of the two compartments may be desirable in some applications to maintain the two compartments at approximately the same temperature. However, this device is not well suited for insulating the two compartments relative to one another where it is desirable to maintain the two compartments at different temperatures. An insulated container constructed in accordance with the teachings of the '544 patent would facilitate thermal homeostasis rather than prevent it.

Another drawback of the container described in the '544 patent is that it is often difficult to clean. Typically, the size of insulated containers render them difficult to wash and incapable of being placed within a standard dishwasher or household sink for easy cleaning. Many users find it necessary to clean such coolers outside with a garden hose. Aside from being a laborious task, cleaning the container outdoors with a garden hose substantially limits the degree of cleaning possible. Outdoors debris and contaminants may find their way into the container when cleaning in this manner. This may be particularly undesirable where maintaining a sanitary environment is critical. The device described in the '544 patent also does nothing to securely fasten beverage containers such as bottles or cans in an upright orientation. Accordingly, these beverage containers would be free to tip over and leak if the insulated container happens to be jarred or tipped over.

Another attempt to advance the art of insulated containers is disclosed in U.S. Pat. No. 4,759,467. This patent discloses a disposable cooler liner made from a flexible, impermeable material provided with an adhesive to attach the liner within the chest. The liner includes thin inner walls to provide separate compartments such that the contents may be separated from one another while maintaining each compartment at approximately the same temperature.

Once again, this device does not thermally isolate the separate compartments. Additionally, the use of a flexible impermeable liner allows for easy removal and disposal, but frustrates the user's ability to easily clean and reuse the liner. If the user desires to wash the flexible liner in a dish washer it would be difficult to keep the liner open so that it can be fully cleaned. This would present a substantial problem in applications where maintaining a sanitary environment is critical. Moreover, once the liner has been removed and cleaned the adhesive is likely to be compromised.

One application in which insulated storage containers are utilized is by mothers of newborn babies. Often when they leave home for an extended period of time it is desirable to bring along milk, juice or formula for the baby. In such applications the mother may desire to refrigerate some bottles to prevent the contents from souring. However, the mother may also wish to simultaneously warm some of the other bottles so that the contents of the bottle are approximately body temperature for feeding. If the above noted devices were utilized the insulated container would be incapable of simultaneously refrigerating some of the bottles while warming the other bottles. Additionally, the bottles would be permitted to tip over and, as is common with baby bottles fitted with nipples, the bottle could spill its contents within the container. Babies have underdeveloped immune systems; therefore, it is critical to be able to sterilize items which are commonly used to care for the baby. If the above noted containers were utilized by a mother, it would difficult to efficiently sterilize the container thus unnecessarily risking the health of the baby.

SUMMARY OF THE INVENTION

An object of the present invention is to overcome the deficiencies present in the prior art.

In accordance with one exemplary embodiment constructed in accordance with certain teachings of the present disclosure, an insulated container id disclosed including a container body with a lid fitted to the container body. The insulated container also includes a liner fitted within the container body and is configured to be removable and reusable. In one embodiment, the liner is constructed from a rigid flexible material so that it is washable. In another embodiment of the present invention, the liner has an inwardly angled configuration in order to shed fluids. In yet another embodiment, the liner may have a latch to releasably secure the liner to the container body. In yet still another embodiment, the liner includes an insulated partition. The insulated partition allows for the insulated container to have two thermally isolated regions so that items may be simultaneously stored in the insulated container at dissimilar temperatures. Each of the above embodiments provide features which provide a multifunctional liner which provides unique advantages over the prior art.

In another embodiment of the present invention, the liner includes at least one coupling cavity. The coupling cavity is configured to securely retain a bottle or can in an upright orientation within the insulated container. Unlike prior art containers which do not positively secure the contents in an upright orientation, in one embodiment of the present invention, the insulated container prevents bottles or cans from tipping over and spilling their contents inside the container.

These together with other objects of the invention, along with the various features of novelty which characterize the invention, are pointed out with particularity in the claims. For a better understanding of the invention, its operating advantages and the specific objects attained by its use, reference should be had to the accompanying drawings and descriptive matter in which there is illustrated preferred embodiments of the invention.

BRIEF DESCRIPTION OF THE DRAWINGS

While the specification concludes with claims which particularly point out and distinctly claim the invention, it is believed that the present invention will be better understood from the following description of embodiments taken in conjunction with the accompanying drawings, in which like reference numerals identify identical elements and wherein:

DESCRIPTION OF EMBODIMENTS

Figure 1:
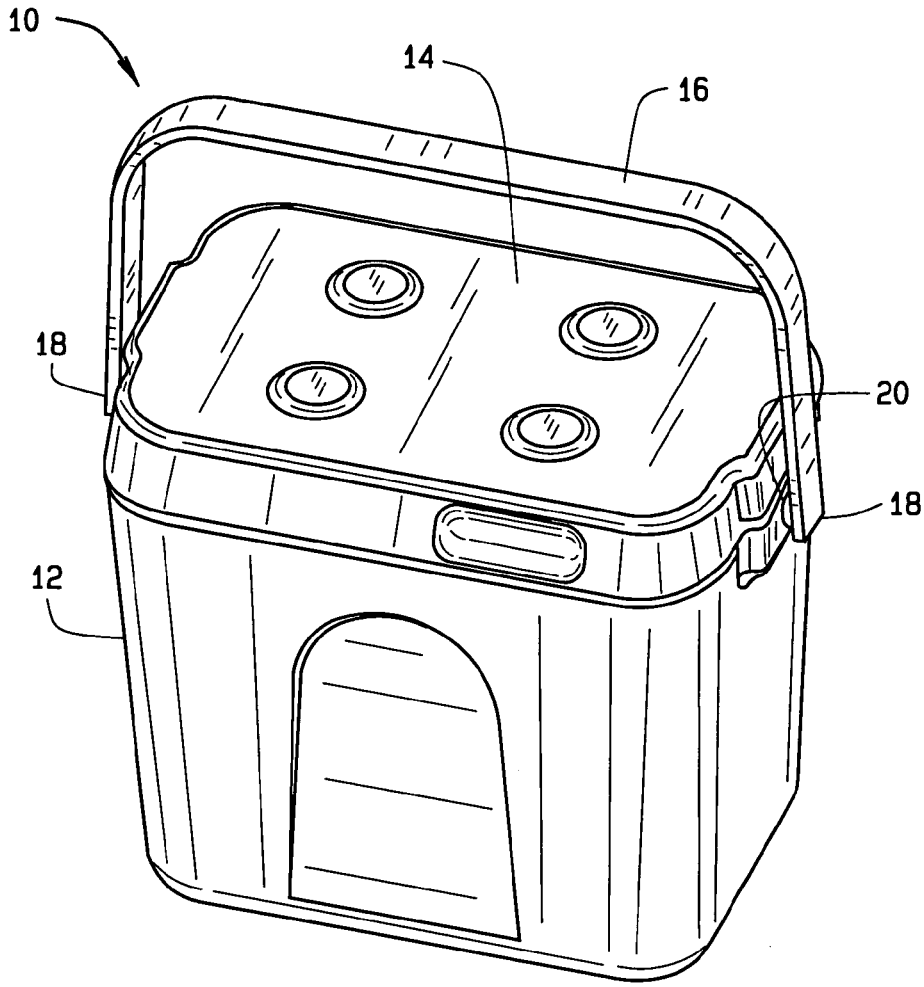
FIG. 1 is a perspective view of the insulated container of the present invention with the lid in a closet orientation.

As best appreciated with reference to FIG. 1, the present invention provides an insulated container 10 having a container body 12 with a lid 14 covering the container body 12. The insulated container also has a handle 16 attached to the container body 12 via a pair of anchors 18 which are fitted into a pair of corresponding apertures 20 to provide a pivotable connection between the handle 16 and container body 12. Alternatively, the handle 16 may be attached to the container body 12 via a variety of other mechanisms. For instance, the handle 16 may be integrally formed into the sides of the container body 12 or lid 14 (not shown). The handle 16 could also be connected to the container body 12 or lid via a sliding connection with a boss which travels within a track (not shown).

Figure 2:
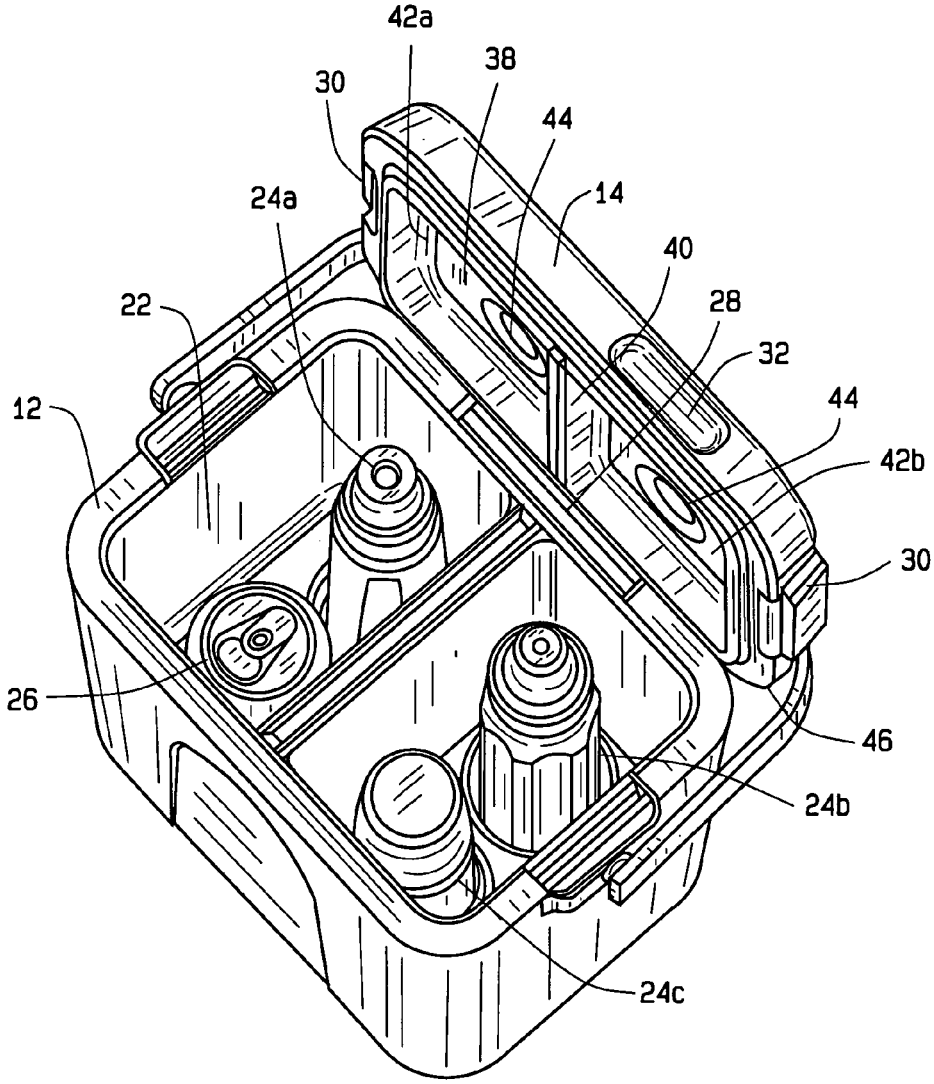
FIG. 2 is a perspective view of the insulated container of the present invention with the lid in an open orientation.
Figure 3:
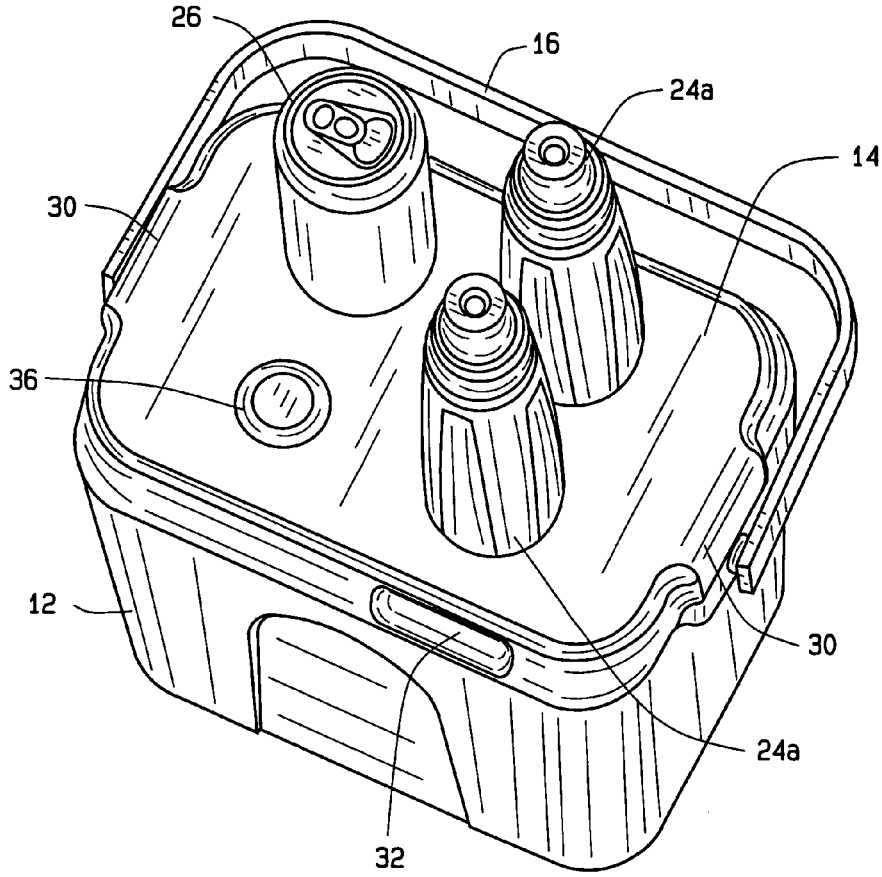
FIG. 3 is a perspective view of the insulated container of the present invention with a can and two bottles supported by the lid.

FIG. 2 shows the insulated container 10 with the lid 14 in an open configuration exposing the internal cavity 22 of the insulated container 10. Various bottles 24*a*, 24*b*, 24*c* and cans 26 may be secured within the internal cavity 22 as explained in further detail below. The lid 14 is pivotably connected to the container body 12 via a hinge 28. With particular reference to FIGS. 2 and 3, the lid 14 has ledges 30 to prevent inadvertent contact with the anchors 18 when the lid 14 is in the closed orientation. To open the lid 14, the lid 14 has a recess 32 where the user may grasp the lid 14 to pivot the lid 14. An upper surface 34 of the lid 14 has domed portions 36 to secure a can 26 or bottle 24. Alternatively, the upper surface 34 may also include recesses (not shown) to secure a can 26 or bottle 24 to the lid 14. As seen in FIG. 2, a lower surface 38 of the lid 14 has a rib 40 which separates the lower surface 38 into two regions 42*a* and 42*b*. To prevent the bottles 24 from tipping over when located within insulated container 10, the lower surface 38 of the lid 14 has concave portions 44 which receive at least a portion of a can 26 or bottle 24. A bead or gasket 46 extends from the lower surface 38 of the lid 14 to releasably seal the internal cavity 22.

Figure 4:
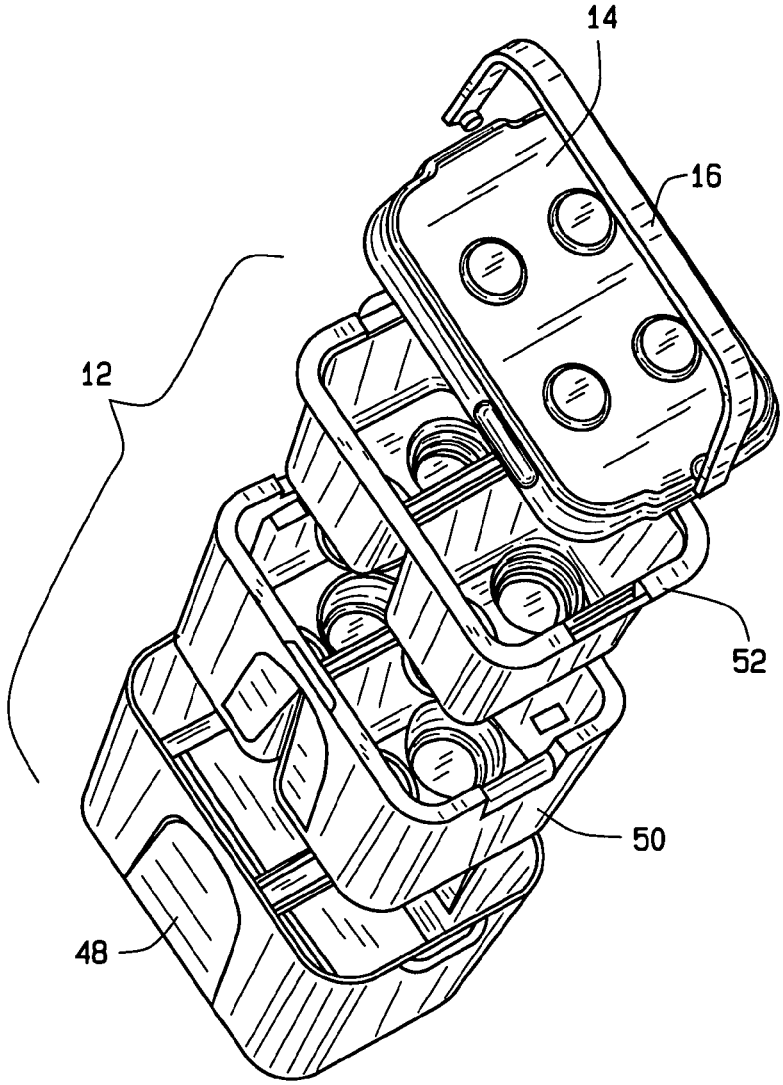
FIG. 4 is an exploded perspective view of the insulated container.
Figure 5:
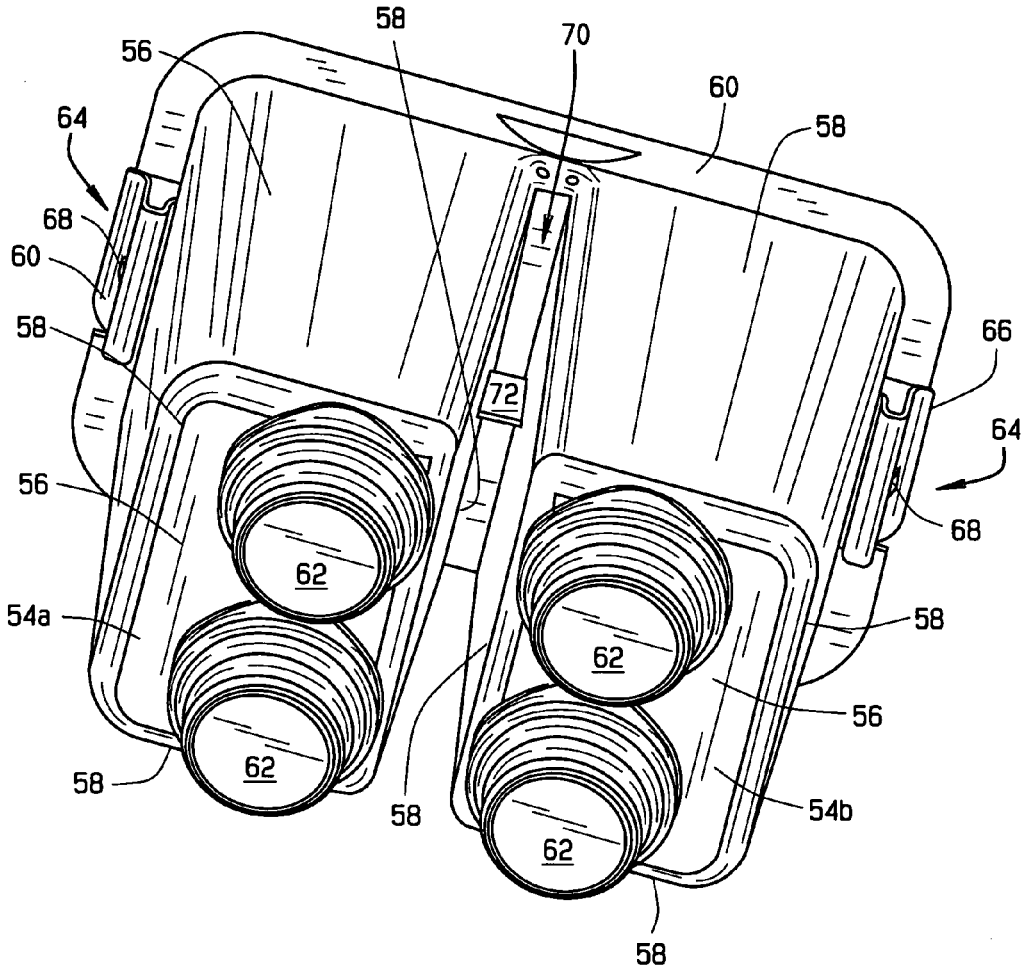
FIG. 5 is a perspective view of a liner of the present invention.
Figure 6:
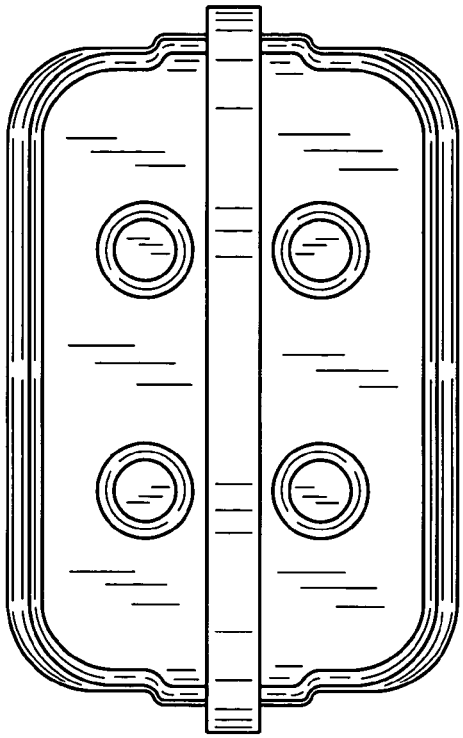
FIG. 6 is a top plan view of the insulated container.

As shown in FIG. 4, the container body 12 includes an outer shell 48 an insulated layer 50 fitted within the outer shell 48 and a liner 52 releasably secured within the insulating layer 50. The liner is formed from a flexible rigid plastic material or any other cost-effective, easily manufacturable, durable material. Turning to FIG. 5, the liner 52 has two chambers 54*a*, 54*b*. Of course the insulated container 10 could be further divided into additional chambers without departing from the spirit or scope of this invention. Each chamber 54*a*, 54*b* is defined by a bottom surface 56 and four side walls 58. Surrounding the side walls 58 is a lip 60. The side walls 58 are inwardly tapered from the lip 60 towards the bottom surface 56. Rather than having to wash the entire insulated container which is often cumbersome and difficult to perform reliably, the liner 52 of the present invention may be removed and cleaned separate from the outer shell 48 and the insulated layer 50. The tapered configuration of the side walls 58 allows the liner 52 to shed water when inverted thus facilitating thorough cleaning when inverted and placed in a common household washing machine.

Formed into the bottom surface 56 are coupling cavities 62. Preferably, each coupling cavity 62 is configured to receive multiple different bottles 24 or cans 26. A pair of latches 64 are formed into the liner 52 adjacent the lip 60. Each latch 64 has a flexible arm 66 with a hook 68 to secure the liner 52 to the outer shell 48. The liner 52 is separated into the two chambers 54*a*, 54*b* by an elongate channel 70. To enhance the structural rigidity of the liner 52 a rib 72 is formed between the chambers 56 within the elongate channel 70.

Figure 7:
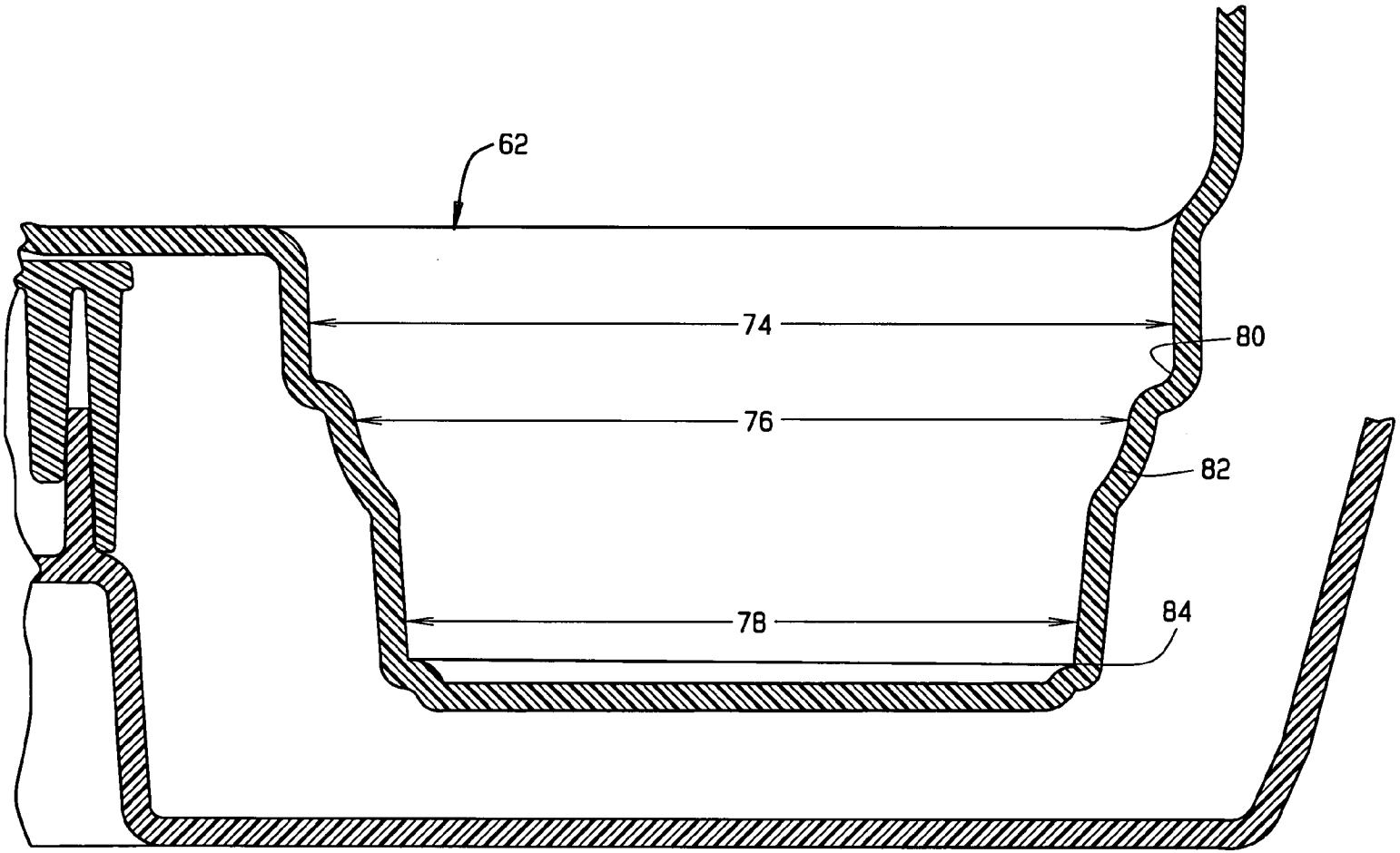
FIG. 7 is a cross-sectional view of the insulated container though line A-A of FIG. 6 through one of the coupling cavities.

As shown in FIG. 7, each coupling cavity 62 is configured to receive different sized cans 24 or bottles 26. Each coupling cavity 62 has a first cylindrical cross-section 74 of about approximately 2.6 inches in diameter, a second cylindrical cross-section 76 of about approximately 2.3 inches in diameter, a third cylindrical cross-section 78 of about approximately 2.0 inches in diameter. Between the first cylindrical cross-section 74 and the second cylindrical cross-section 76, is a first taped portion 80. Between the second cylindrical cross-section 74 and the third cylindrical cross-section 76 is a second tapered portion 82. Adjacent the third cylindrical cross-section 78 is a third tapered portion 84. The purpose of this configuration is to permit cans 24 and bottles 26 of differing dimensions to be securely retained within the coupling cavities 62. This unique feature of the invention in combination with the concave portions 44 in the lid 14 prevents a can 26 or bottle 24 from tipping over and spilling its contents within the internal cavity 22. This overcomes one of the most problematic features of transporting bottles 24. If a baby bottle tips over, it may result in spilling its contents creating not only a mess but also an unsanitary condition which is particularly undesirable when used for babies with underdeveloped immune systems.

Figure 8:
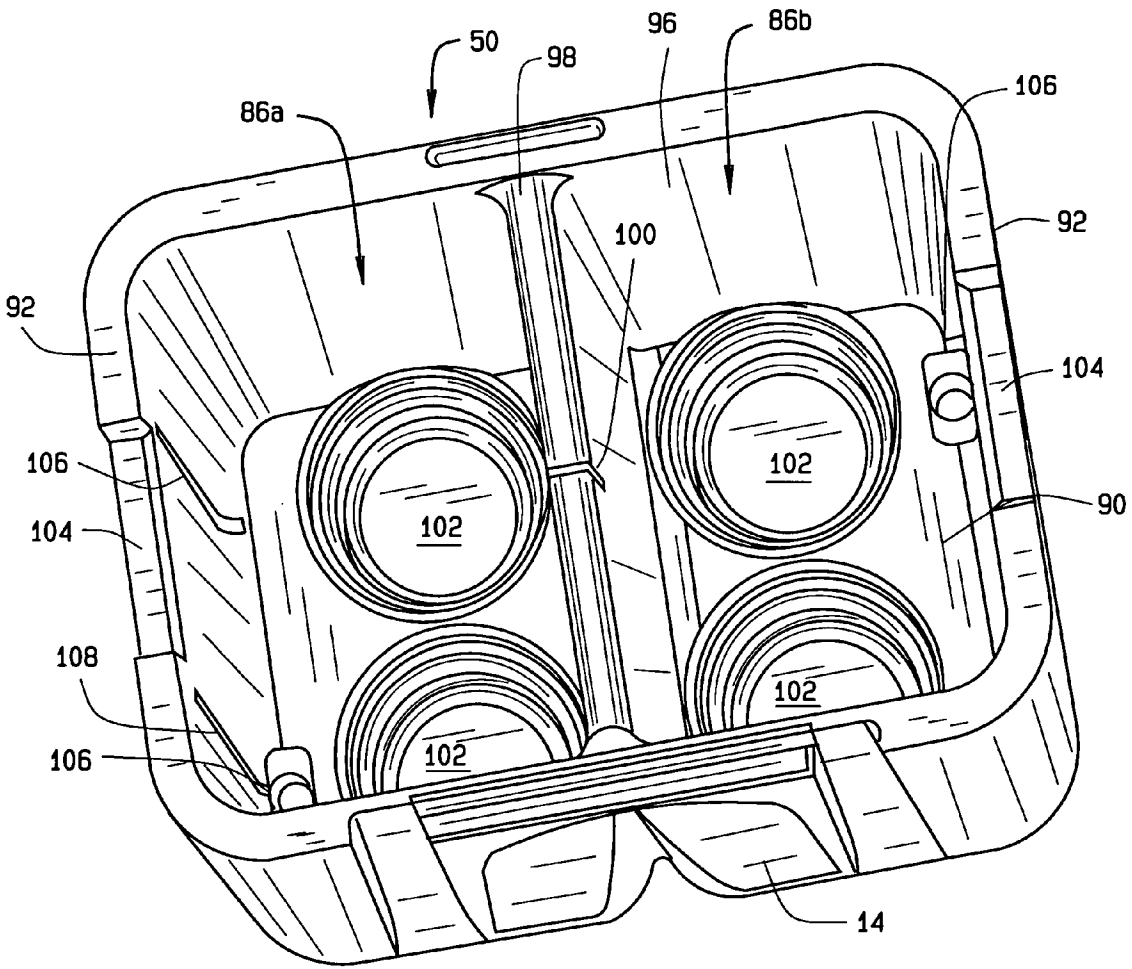
FIG. 8 is a perspective view of an insulating layer of the present invention.

With reference to FIG. 8, the insulating layer 50 may be constructed from a variety of materials such expanded polystyrene foam commonly sold under the trademark Styrofoam or any other insulating material capable of providing an insulation. The insulating layer 50 has chambers 86*a*, 86*b* corresponding to the chambers 54*a*, 54*b* of the liner 52. The insulated layer 50 has a bottom wall 90 with a pair of side walls 92, a front wall 94 and a rear wall 96 extending from the bottom wall 90. Separating the chambers 86*a*, 86*b* is an insulated partition 98. This insulated partition 98 thermally isolates the chambers 86*a*, 86*b* from one another. This unique feature of the invention permits items to be stored in the same insulated container at different temperatures. For instance, a caregiver for a newborn baby may wish to refrigerate bottles 24 containing formula within one of the chambers 86*a* or 86*b* while simultaneously warm another bottle 24 in the other chamber 86*a* or 86*b*. Of course this feature may also have multiple other applications. For instance, a camper may wish to store beverages at a cool temperature within one of the chambers 86*a* or 86*b* while also storing a soup, casserole or other item simultaneously at a heightened temperature. These examples are merely exemplary and a multitude of other applications could utilize the unique features of the present invention. In either of the above examples, one of the chambers 86*a*, 86*b* could be cooled by ice or an enclosed gel refrigerant and the other chamber 86*a*, 86*b* could be warmed by a enclosed gel heat pad.

The insulated layer 50 has a groove 100 to engage with rib 40 and scalloped portions 102 to engage with the coupling cavities 62 in order to maintain proper alignment between the insulated layer 50 and the liner 52. Channels 104 are formed on the side walls 92 to provide clearance for the latches 64. Through holes 106 are formed in the bottom surface 90 of the insulated portion 98 in order to permit affixing the insulated layer 50 to the outer shell 48 as will be explained in further detail below. Yet another unique feature of the present invention is that it includes vents 108. The vents 108 allow for air trapped between the liner 52 and insulated layer 50 to be vented as the liner 52 is inserted adjacent the insulated layer 50 in order to easy assembly and reduce wear on the insulated container 10. The vents 108 also allow for air to seep into the region between the liner 52 and the insulated layer 50 in order to depressurize this region as the liner 52 is removed.

Figure 9A:
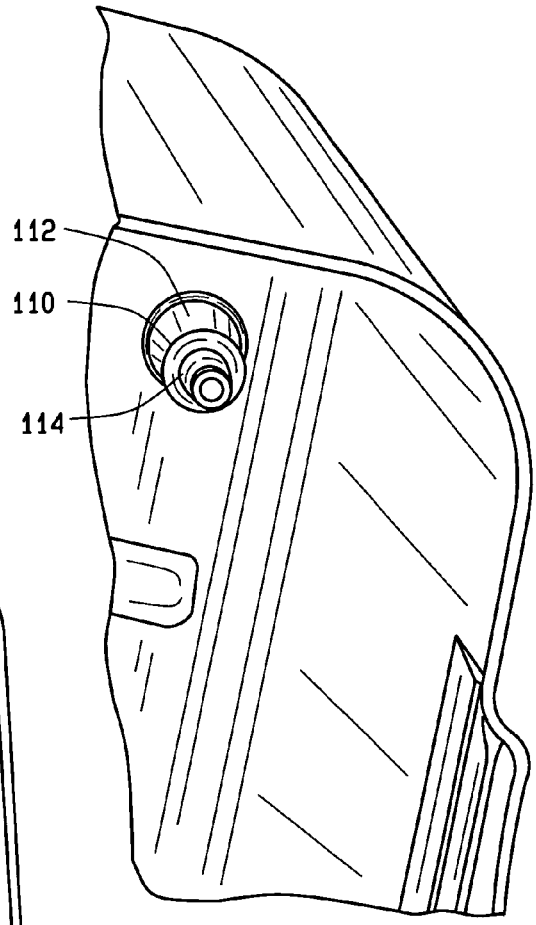
FIG. 9*a* is a partial perspective view of the container body about the first locking member.
Figure 9B:
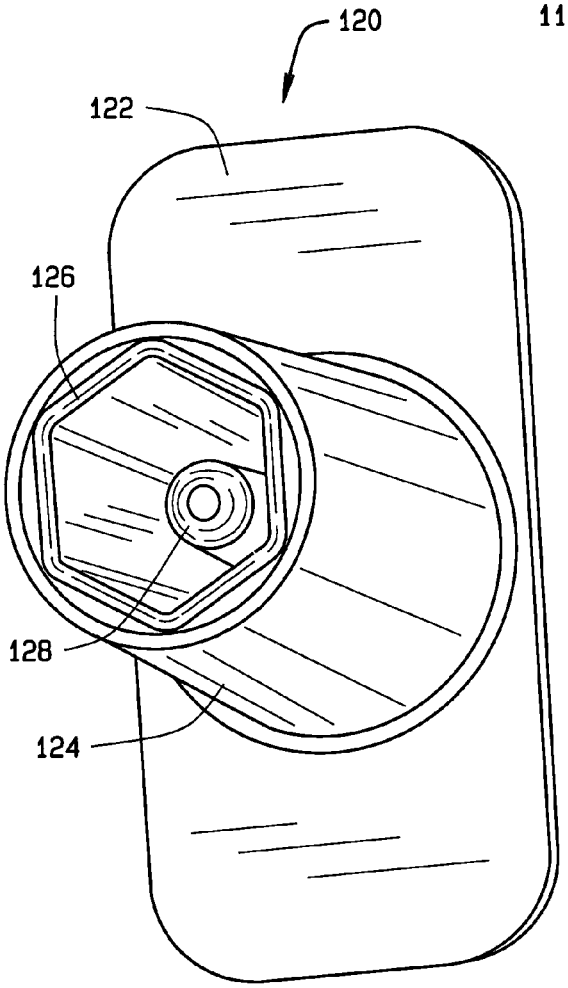
FIG. 9*b* is a perspective view of the second locking member.
Figure 10:
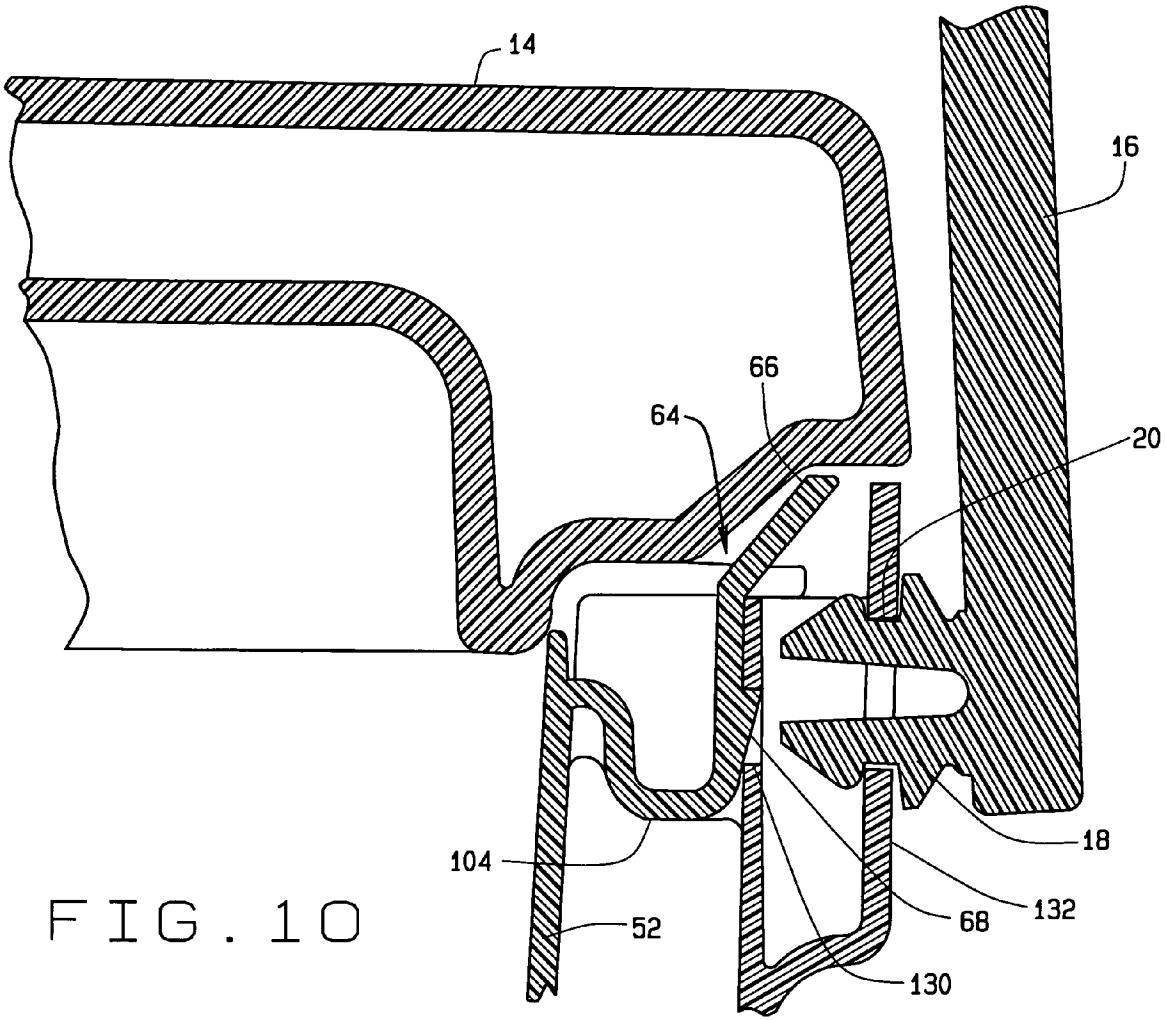
FIG. 10 is a partial cross-section along line B-B of FIG. 6 about the hinge assembly about the anchor which pivotably engages the outer shell of the insulated container.

FIGS. 9*a* and 9*b*, show the locking mechanism utilized to secure the insulated layer 50 to the outer shell 48. The locking mechanism includes a first member 110 integrally molded to the outer shell 48. The first member 112 has a base portion 114 with a cylindrical portion 116 extending therefrom. The cylindrical portion 116 has an octagonal inner bore 118. The second member 120 has a planar portion 122 with a cylindrical portion 124 extending therefrom. The cylindrical portion has an octagonal inner bore 126 with a projection 128 extending within the inner bore 126. To assemble the body, the inner layer 50 is aligned within the outer shell 48 such that the first members 112 extend upward into the through holes 106 in the insulated layer 50. To secure the insulated layer 50 in place, second members 120 are pressed down onto corresponding first members in order to lock the insulated layer 50 in place. Of course a suitable adhesive could also be utilized without departing from the unique aspects of this invention.

As best appreciated with reference to FIG. 11, the hook 68 of the latch 64 engages a slot or depression 130 formed in the outer shell 48 to releasably secure the liner 52 within the inner layer 50. The latches 64 may be released in order to permit the removal of the liner 52 by pressing the flexible arms 66 inwardly to disengage the hooks 68 from the outer shell 48. Due to the flexible nature of the latches 64, the hooks 68 will automatically reengage the slots 130 when fully inserted into location. A band 132 extends from the outer shell 48 and includes the aperature 20 which receives the anchor 18 formed on the handle 16. The aperature 20 and anchor 18 are cylindrical in shape so that the handle 16 is free to pivot relative to the body 12.

Although particular embodiments of the present invention have been illustrated and described, modifications may be made without departing from the teachings of the present invention. Accordingly, the scope of the invention shall be limited only by the following claims.

What is claimed is:

1. An insulated container comprising:

a container body;

a lid comprising an upper surface and a lower surface;

an insulating layer fitted within the container body, said insulating layer having a bottom insulating wall and four upstanding insulating walls extending from the bottom insulating wall, said insulating layer having an elongate partition separating the insulating layer into two compartments, said elongate partition extending proximate the lid such that each compartment is substantially thermally isolated from one another so that different relative temperatures may be maintained in each compartment; and a liner configured to be removable and reusable, said liner fits substantially within the container body wherein the liner approximately conforms with the contours of the insulating layer, and wherein said liner includes a plurality of coupling cavities, wherein said lid comprises at least one recess formed in the lower surface of said lid aligned with a corresponding coupling cavity such that when said lid is secured to said container body an object is supported in an approximately upright orientation, wherein a top portion of the object is received within the at least one recess of the lid, a bottom portion of the object is received within the corresponding coupling cavity of the liner, and a middle portion of the object is vertically spaced from both the corresponding coupling cavity and the at least one recess.

2. The insulating container as recited in claims claim 1, wherein each coupling cavity comprises:

a first portion having a cross-sectional shape;

a second portion adjacent the first portion having a smaller cross-sectional shape than the first portion; and a third portion adjacent the second portion having a smaller cross-sectional shape than the second portion, wherein each portion of a coupling cavity is concentric and wherein each coupling cavity may securely hold objects having an outer size and shape approximately corresponding to any one of the first portion, second portion, or third portion.

3. The insulating container as recited in claim 2, wherein the cross-sectional shape of the first portion, the second portion, and the third portion are polygonal.

4. The insulating container as recited in claim 2, wherein said first portion has a cylindrical cross-section with a diameter of approximately 2.6 inches.

5. The insulating container as recited in claim 2, wherein said second portion has a cylindrical cross-section with a diameter of approximately 2.3 inches.

6. The insulating container as recited in claim 2, wherein said third portion has a cylindrical cross-section with a diameter of approximately 2 inches.

7. The insulated container as recited in claim 1, wherein the liner further comprises a pair of side walls forming an elongate channel.

8. The insulating container as recited in claim 7, wherein the elongate partition fits in the elongate channel.

9. The insulated container as recited in claim 8, wherein the lid further comprises a rib, and wherein the pair of side walls abut the rib.

10. An insulated container comprising:

a container body;

an insulating layer fitted within the container body, said insulating layer having a bottom insulating wall and four upstanding insulating walls extending from the bottom insulating wall, said insulating layer having an elongate partition separating the insulating layer into two compartments such that each compartment is substantially thermally isolated from one another so that different relative temperatures may be maintained in each compartment; and a liner fitted within the insulating layer, wherein the liner approximately conforms with the contours of the insulating layer, the liner having at least one coupling cavity; and wherein said coupling cavity comprises a first portion having a cylindrical cross-section; a second portion adjacent the first portion having a smaller cylindrical cross-section than the first portion; a third portion adjacent the second portion having a smaller cylindrical cross-section than the second portion, wherein each portion of a coupling cavity is concentric and wherein each portion may securely hold objects having an outer diameter corresponding to an one of the first portion, second portion, or third portion within the insulating layer; and a lid comprising an upper surface and a lower surface, wherein said lid comprises at least one recess formed in the lower surface of said lid aligned with a corresponding coupling cavity such that when said lid is secured to said container body an object is supported in an approximately upright orientation, wherein a top portion of the object is received within the at least one recess of the lid, a bottom portion of the object is received within the corresponding coupling cavity of the liner, and a middle portion of the object is vertically spaced from both the corresponding coupling cavity and the at least one recess.

11. The insulated container as recited in claim 10, wherein said liner comprises at least one latch, said latch comprising:

a flexible arm having a hook formed on said liner; and a slot formed in said container body having an aperture for receipt of said hook.

12. The insulated container as recited in claim 10, wherein said liner further comprises a channel formed in said liner to vent air trapped between said liner and said insulated layer.

13. The insulated container as recited in claim 10, wherein said upper surface has at least one domed portion, wherein said domed portion is sized to fit with a recess of a can or bottle.

14. An insulating container comprising:

a container body having a bottom container wall and four upstanding container side walls;

an insulating layer fitted within the container body, said insulating layer having a bottom insulating wall and four upstanding insulating walls extending from the bottom insulating wall, said insulating layer having an elongate partition extending from the bottom insulating wall separating the insulating layer into two compartments such that each compartment is substantially thermally isolated from one another so that different relative temperatures may be maintained in each compartment; and a liner fitted within the insulating layer, the liner having at least one coupling cavity; and wherein said coupling cavity comprises a first portion having a cylindrical cross-section; a second portion adjacent the first portion having a smaller cylindrical cross-section than the first portion; a third portion adjacent the second portion having a smaller cylindrical cross-section than the first portion wherein each portion of a coupling cavity is concentric and wherein each coupling cavity may securely hold objects having an outer size and shape approximately corresponding to any one of the first portion, second portion or third portion, wherein the liner approximately conforms with the contours of the insulating layer;

a lid comprising an upper surface and a lower surface, wherein said lid comprises at least one recess formed in the lower surface of said lid aligned with a corresponding coupling cavity such that when said lid is secured to said container body an object is supported in an approximately upright orientation, wherein a top portion of the object is received within the at least one recess of the lid, a bottom portion of the object is received within the corresponding coupling cavity of the liner, and a middle portion of the object is vertically spaced from both the corresponding coupling cavity and the at least one recess.

15. The insulating container as recited in claim 14, wherein said first portion has a cylindrical cross-section with a diameter of approximately 2.6 inches.

16. The insulating container as recited in claim 14, wherein said second portion has a cylindrical cross-section with a diameter of approximately 2.3 inches.

17. The insulating container as recited in claim 14, wherein said third portion has a cylindrical cross-section with a diameter of approximately 2 inches.

* * * * *